US011933507B2

(12) United States Patent
Jo et al.

(10) Patent No.: US 11,933,507 B2
(45) Date of Patent: Mar. 19, 2024

(54) AIR CONDITIONER

(71) Applicant: SAMSUNG ELECTRONICS CO., LTD., Suwon-si (KR)

(72) Inventors: Younglae Jo, Suwon-si (KR); Byungkwan Kang, Suwon-si (KR); Yonghee Yoon, Suwon-si (KR); Junghui Choi, Suwon-si (KR); Jongmin Lee, Suwon-si (KR); Eomji Jang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 341 days.

(21) Appl. No.: 16/810,206

(22) Filed: Mar. 5, 2020

(65) Prior Publication Data

US 2020/0284455 A1 Sep. 10, 2020

(30) Foreign Application Priority Data

Mar. 5, 2019 (KR) ..... 10-2019-0024988

(51) Int. Cl.

| | |
|---|---|
| ***F24F 11/30*** | (2018.01) |
| ***F24F 11/56*** | (2018.01) |
| ***F24F 11/89*** | (2018.01) |
| ***F24F 13/20*** | (2006.01) |
| ***F24F 13/22*** | (2006.01) |

(Continued)

(52) U.S. Cl.

CPC ..... *F24F 11/30* (2018.01); *F24F 11/56* (2018.01); *F24F 11/89* (2018.01); *F24F 13/20* (2013.01); *F24F 13/222* (2013.01); *F24F 13/24* (2013.01); *F24F 13/30* (2013.01); *F24F 2013/205* (2013.01); *F24F 2013/227* (2013.01)

(58) Field of Classification Search

CPC .. F24F 11/30; F24F 11/59; F24F 11/89; F24F 13/20; F24F 13/222; F24F 13/24; F24F 2013/227; F24F 2013/205; F24F 2013/247

See application file for complete search history.

(56) References Cited

U.S. PATENT DOCUMENTS

| | | | |
|---|---|---|---|
| 9,510,073 | B2 | 11/2016 | Park et al. |
| 10,015,574 | B1 | 7/2018 | Luce et al. |
| 2014/0341414 | A1 | 11/2014 | Park et al. |

(Continued)

FOREIGN PATENT DOCUMENTS

| | | | |
|---|---|---|---|
| CN | 104180438 | A | 12/2014 |
| CN | 105258226 | A | 1/2016 |

(Continued)

OTHER PUBLICATIONS

European Search Report dated Dec. 22, 2021 issued in European Application No. EP 20 76 5875.

(Continued)

*Primary Examiner* — Tavia Sullens

(74) *Attorney, Agent, or Firm* — STAAS & HALSEY LLP

(57) ABSTRACT

An air conditioner including a housing having an inlet and an outlet, a heat exchanger disposed inside the housing to exchange heat with air introduced into the inlet, a fan configured to blow air heat-exchanged in the heat exchanger to the outlet, and a speech recognizer including a microphone, a speaker, and a case accommodating the microphone and the speaker, and to operate the air conditioner using the microphone and the speaker.

12 Claims, 9 Drawing Sheets

(51) Int. Cl.
*F24F 13/24* (2006.01)
*F24F 13/30* (2006.01)

(56) References Cited

U.S. PATENT DOCUMENTS

| | | | |
|---|---|---|---|
| 2016/0025357 | A1 | 1/2016 | Suzuki et al. |
| 2017/0149942 | A1 | 5/2017 | Lee et al. |
| 2017/0370605 | A1 | 12/2017 | Makino et al. |
| 2018/0330727 | A1 | 11/2018 | Tulli |

FOREIGN PATENT DOCUMENTS

| | | | | |
|---|---|---|---|---|
| CN | 105553799 | | | 5/2016 |
| CN | 106568178 | A | * | 4/2017 |
| CN | 106705256 | A | | 5/2017 |
| CN | 206176555 | U | | 5/2017 |
| CN | 206514415 | U | | 9/2017 |
| EP | 3 174 308 | B1 | | 5/2017 |
| JP | 8-200780 | | | 8/1996 |
| JP | 2005-201565 | | | 7/2005 |
| JP | 2006033494 | A | * | 2/2006 |
| JP | 2006087129 | A | * | 3/2006 |
| KR | 10-2019-0011104 | | | 2/2019 |
| WO | WO 2016/186717 | A1 | | 11/2016 |
| WO | WO 2019/013335 | A1 | | 1/2019 |
| WO | WO 2019/013349 | A1 | | 1/2019 |
| WO | WO-2019013349 | A1 | * | 1/2019 ..... F24F 11/50 |

OTHER PUBLICATIONS

International Search Report dated Jun. 30, 2020 in International Patent Application No. PCT/KR2020/002834.

Office Action dated Aug. 3, 2022 issued in Chinese Application No. 202080018018.8.

Office Action dated Jan. 18, 2023 issued in Chinese Application No. 202080018018.8.

European Search Report dated Mar. 27, 2023 issue in European Application No. 20 765 875.8.

Office Action dated Apr. 26, 2023 issued in Chinese Application No. 202080018018.8.

Office Action dated Jul. 28, 2023 issued in Korean Application No. 10-2019-0024988.

* cited by examiner

AIR CONDITIONER

CROSS-REFERENCE TO RELATED APPLICATION(S)

This application is based on and claims priority under 35 U.S.C. § 119 to Korean Patent Application No. 10-2019-0024988, filed on Mar. 5, 2019, in the Korean Intellectual Property Office, the disclosure of which is incorporated by reference herein in its entirety.

BACKGROUND

1. Field

The disclosure relates to an air conditioner including a speech recognizer.

2. Description of Related Art

In general, an air conditioner is an apparatus that controls temperature, humidity, airflow, and distribution suitable for human activity using a refrigeration cycle. The refrigeration cycle is composed of a compressor, a condenser, an evaporator, a blowing fan, and the like as main components.

The air conditioner may be classified into a separate type air conditioner in which an indoor unit and an outdoor unit are separately installed, and an integrated air conditioner in which an indoor unit and an outdoor unit are installed together in one cabinet. The indoor unit of the separate type air conditioner includes a heat exchanger for heat-exchanging air sucked into a panel, and a blowing fan for sucking air in a room into the panel and blowing the sucked air back into the room.

The integrated air conditioner may be installed such that one side thereof directs to the inside of a room and the other side thereof directs to the outside. For example, the integrated air conditioner may be installed on a window. The separate type air conditioner may be classified into a stand type air conditioner in which the indoor unit is installed on a floor, and a wall-mounted air conditioner in which the indoor unit is attached to a wall.

The air conditioner may be operated by an operation panel provided in a main body or by a remote controller. Because the wall-mounted air conditioner is often installed on an upper portion of a wall which is out of reach of a user, the remote controller needs to be used to easily manipulate the wall-mounted air conditioner.

SUMMARY

It is an aspect of the disclosure to provide an air conditioner including a speech recognizer for manipulation of the air conditioner.

Additional aspects of the disclosure will be set forth in part in the description which follows and, in part, will be apparent from the description, or may be learned by practice of the disclosure.

In accordance with an aspect of the disclosure, an air conditioner includes a housing having an inlet and an outlet, a heat exchanger disposed inside the housing to exchange heat with air introduced into the inlet, a fan configured to blow air heat-exchanged in the heat exchanger to the outlet, and a speech recognizer including a microphone, a speaker, and a case accommodating the microphone and the speaker, and to operate the air conditioner using the microphone and the speaker.

The housing may include a piping space formed therein and in which a refrigerant pipe configured to supply a refrigerant to the heat exchanger or a drain pipe configured to discharge condensed water generated in the heat exchanger is disposed. The speech recognizer may be disposed in the piping space.

The piping space may be disposed at a lower part of the housing. The microphone and the speaker may be disposed to direct to the lower part of the housing.

The air conditioner may further include a holder configured to allow the speech recognizer to be mounted.

At least one of the holder and the case of the speech recognizer may include a protrusion part to allow an air layer to be formed between the holder and the speech recognizer.

The speech recognizer may further include a controller configured to control the microphone and the speaker.

The speech recognizer may further include a wireless communication module. The controller may control the wireless communication module to communicate with external wireless devices.

The case may include a first member and a second member. The first member may include a first opening for the speaker and a second opening for the microphone.

At least one of the first member and the second member may include a partition wall configured to isolate the speaker and the microphone.

The second member may include a protrusion part protruding in an outward direction of the case to allow an air layer to be formed at an outer side of the case.

The speech recognizer may further include a vibration reducing member disposed between the case and the speaker such that vibration of the speaker is not transmitted to the case.

The microphone may be disposed to be tilted toward a front of the housing.

The outlet may be provided in a front of the housing, and the microphone may be disposed in the rear of a lower part of the housing.

The housing may include an upper panel, a front panel, side panels, and a lower panel. The speech recognizer may be disposed at an inner side of one of the upper panel, the front panel, the side panels, and the lower panel.

In accordance with another aspect of the disclosure, an air conditioner includes a housing including an upper panel, a front panel, and a lower panel, an inlet formed on the upper panel, an outlet formed on the front panel, a speech recognizer disposed at an inner side of the lower panel and including a speaker and a microphone, and to operate the air conditioner using the microphone and the speaker, and a speaker opening and a microphone opening, corresponding to the speaker and the microphone, respectively, formed on the lower panel.

The speech recognizer may include a case configured to accommodate the speaker and the microphone.

The case may include a partition wall configured to isolate the speaker and the microphone.

The air conditioner may further include a holder configured to allow the speech recognizer to be mounted to the inner side of the lower panel of the housing.

At least one of the holder and the case of the speech recognizer may include a protrusion part to allow an air layer to be formed between the holder and the speech recognizer.

The microphone may be disposed in a rear of the inner side of the lower panel to be positioned far from the outlet formed in the front panel and may be disposed to be tilted toward a front of the housing.

BRIEF DESCRIPTION OF THE DRAWINGS

These and/or other aspects of the disclosure will become apparent and more readily appreciated from the following description of the embodiments; taken in conjunction with the accompanying drawings of which.

DETAILED DESCRIPTION

Figure 1:
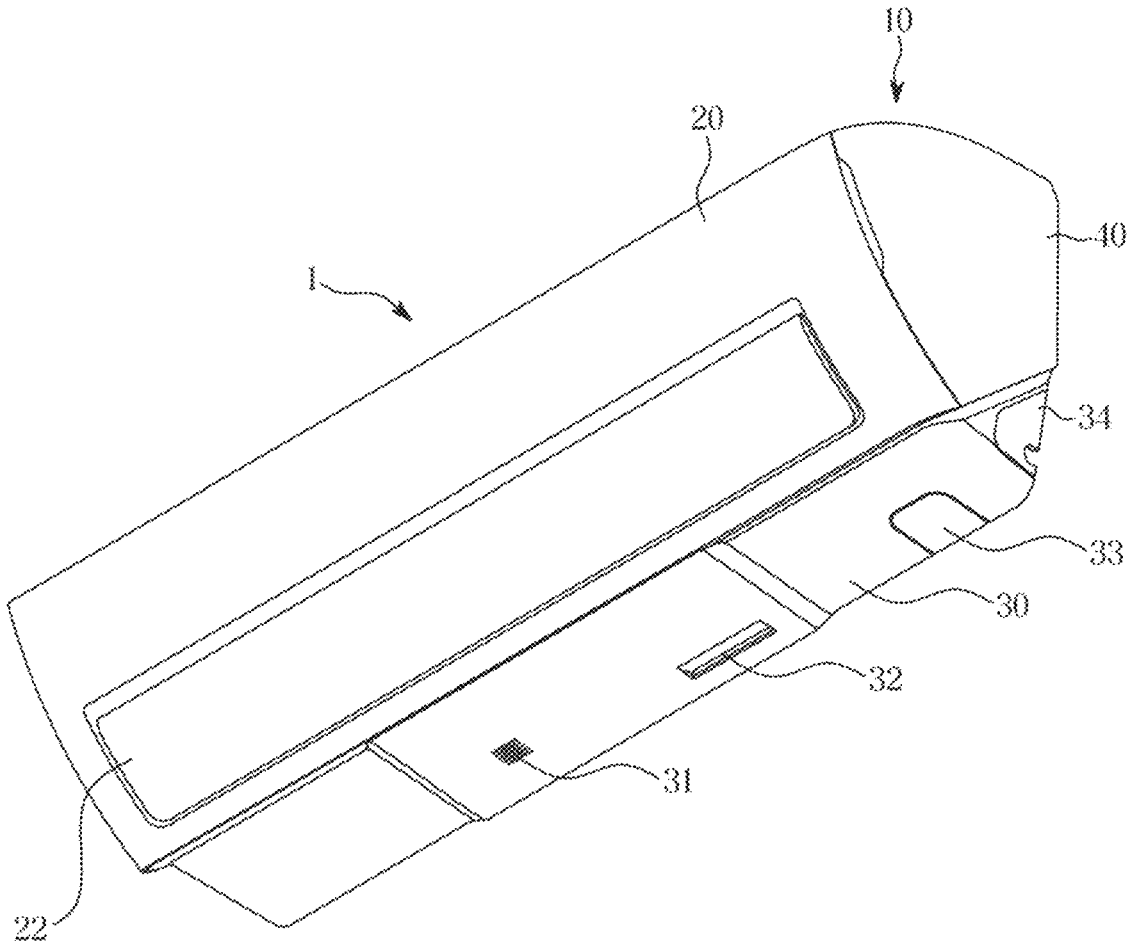
FIG. 1 is a perspective view of an air conditioner according to an embodiment of the disclosure.

Configurations shown in the embodiments and the drawings described in the present specification are only the preferred embodiments of the disclosure, and thus it is to be understood that various modified examples, which may replace the embodiments and the drawings described in the present specification, are possible when filing the present application.

Like reference numbers or signs in the various figures of the application represent parts or components that perform substantially the same functions. The shape and size of the elements in the drawings may be exaggerated for clarity.

The terms used in the present specification are used to describe the embodiments of the disclosure. Accordingly, it should be apparent to those skilled in the art that the following description of exemplary embodiments of the disclosure is provided for illustration purpose only and not for the purpose of limiting the disclosure as defined by the appended claims and their equivalents. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, components, or combination thereof, but do not preclude the presence or addition of one or more other features, figures, steps, components, members, or combinations thereof.

It will be understood that although the terms first, second, etc. may be used herein to describe various components, these components should not be limited by these terms, and the terms are only used to distinguish one component from another. For example, without departing from the scope of the disclosure, the first component may be referred to as a second component, and similarly, the second component may also be referred to as a first component. The term "and/or" includes any combination of a plurality of related items or any one of a plurality of related items.

Hereinafter, embodiments of the disclosure will be described in detail with reference to the accompanying drawings.

A refrigeration cycle of an air conditioner is composed of a compressor, a condenser, an expansion valve, and an evaporator. A refrigerant undergoes a series of processes consisting of compression, condensation, expansion, and evaporation, and a high temperature air is heat exchanged with a low temperature refrigerant to become a low temperature air and supplied to a room.

The compressor compresses a refrigerant gas to a high temperature and high pressure and then discharges the high temperature and high pressure gas, and the discharged refrigerant gas is introduced into the condenser. The condenser condenses the compressed refrigerant into a liquid phase and radiates heat to surroundings through the condensation process. The expansion valve expands a high temperature and high pressure liquid refrigerant condensed in the condenser into a low pressure liquid refrigerant. The evaporator evaporates the refrigerant expanded in the expansion valve. The evaporator uses the latent heat of evaporation of a refrigerant to achieve a cooling effect by heat exchange with an object to be cooled, and returns a low temperature and low pressure refrigerant gas to the compressor. Through this cycle, an air temperature of an indoor space may be controlled.

An outdoor unit of an air conditioner refers to a device consisting of a compressor and an outdoor heat exchanger in a refrigeration cycle. An expansion valve may be disposed in either an indoor unit or the outdoor unit of the air conditioner, and an indoor heat exchanger is disposed in the indoor unit.

Figure 2:
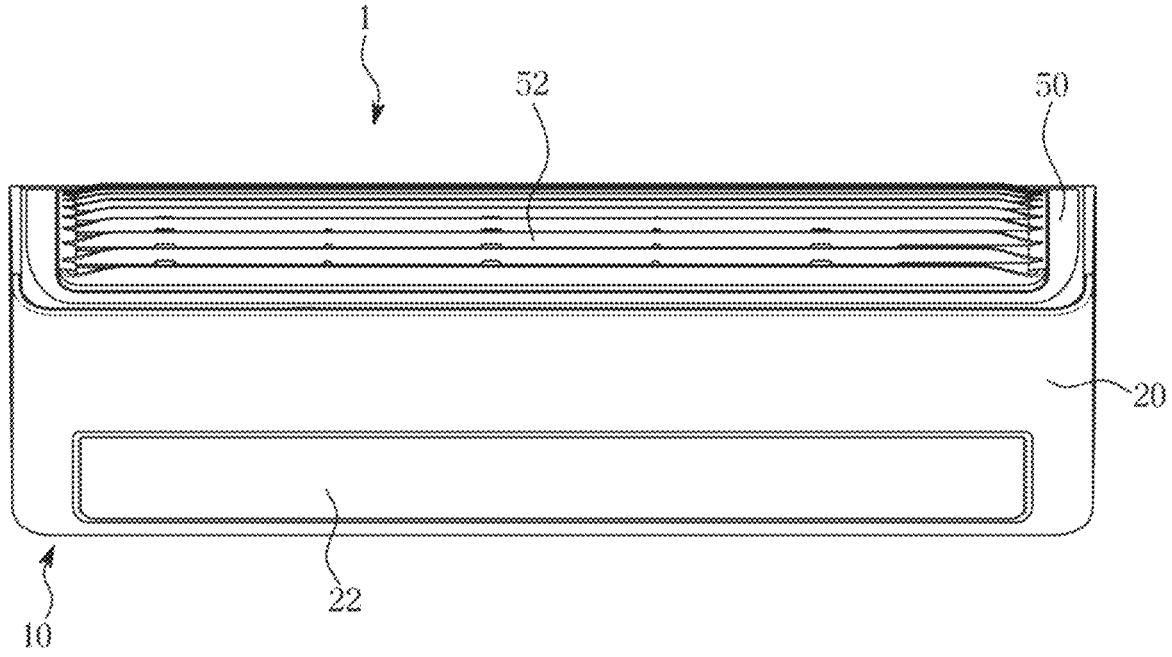
FIG. 2 is a front view of the air conditioner according to an embodiment of the disclosure.
Figure 3:
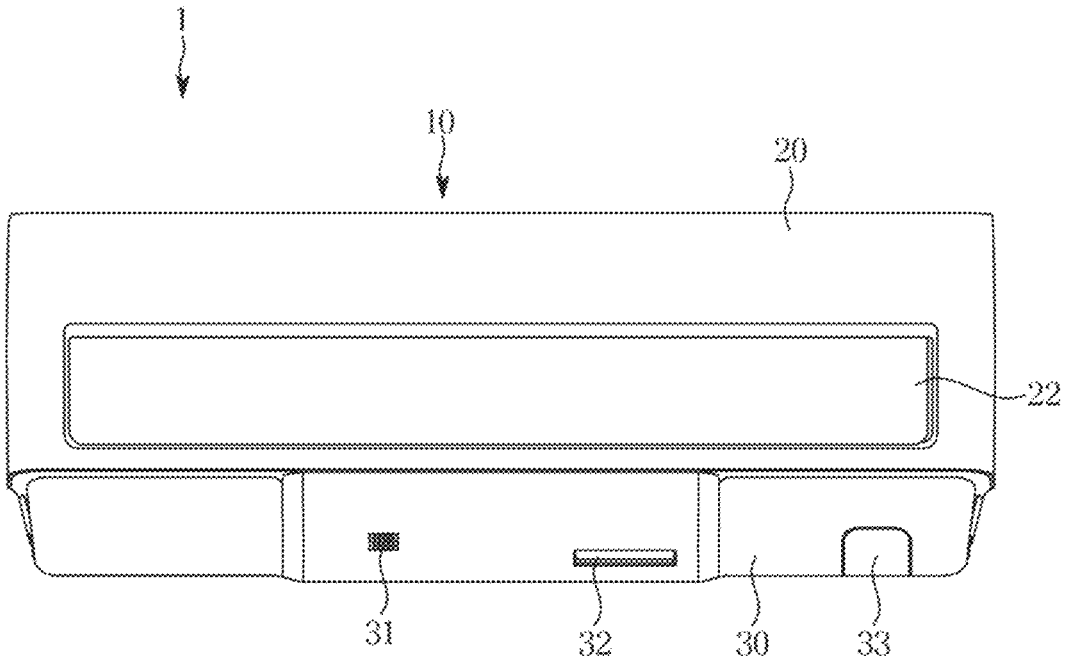
FIG. 3 is a bottom view of the air conditioner according to an embodiment of the disclosure.
Figure 4:
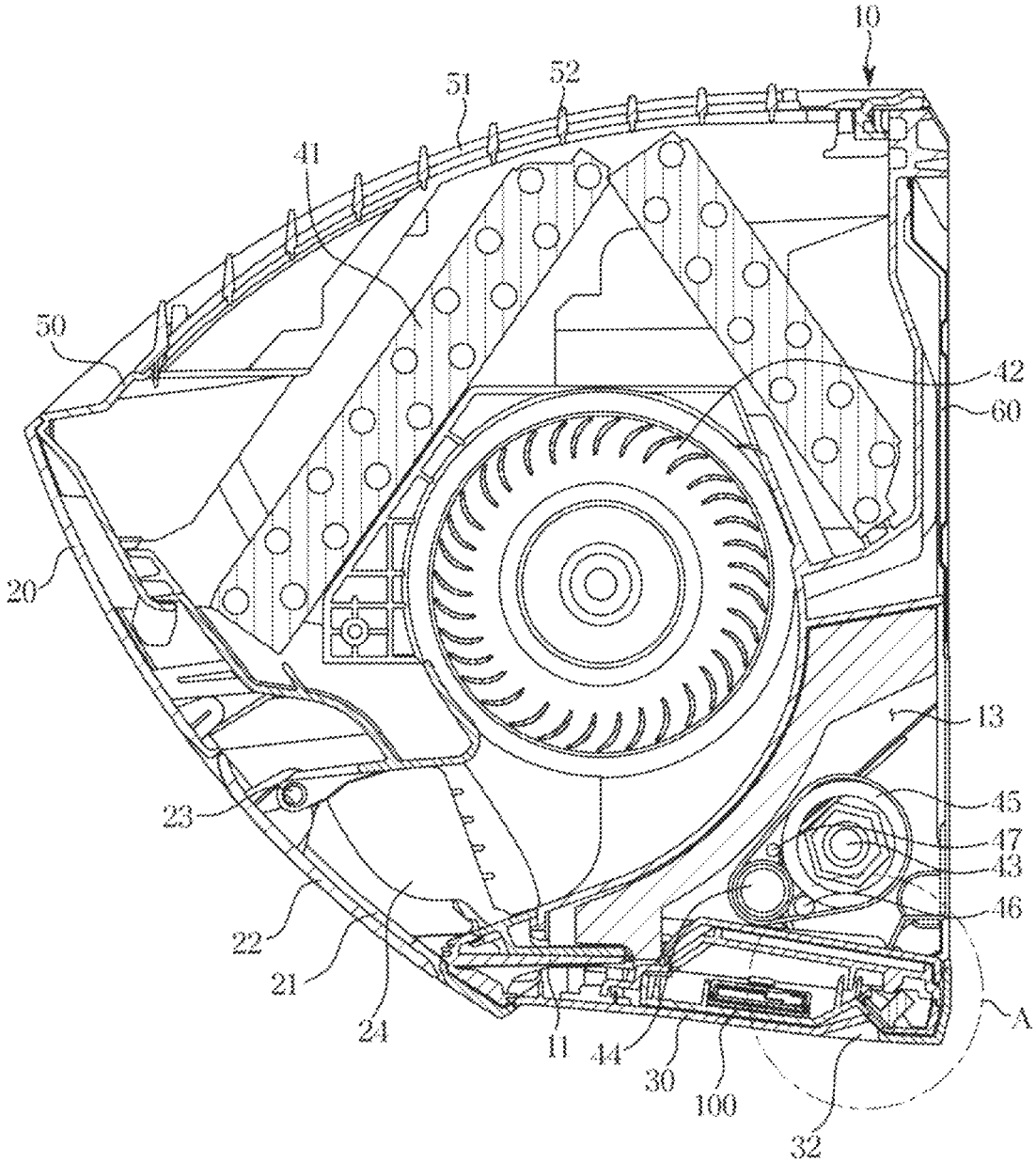
FIG. 4 is a cross-sectional view of the air conditioner according to an embodiment of the disclosure.

The disclosure relates to an air conditioner cooling an indoor space, and the outdoor heat exchanger functions as a condenser and the indoor heat exchanger functions as an evaporator. Hereinafter, for convenience, an indoor unit including an indoor heat exchanger is referred to as an air conditioner, and the indoor heat exchanger is referred to as a heat exchanger, FIG. 1 is a perspective view of an air conditioner according to an embodiment of the disclosure, FIG. 2 is a front view of the air conditioner according to an embodiment of the disclosure, FIG. 3 is a bottom view of the air conditioner according to an embodiment of the disclosure, and FIG. 4 is a cross-sectional view of the air conditioner according to an embodiment of the disclosure.

An air conditioner 1 may include a housing 10 having an inlet 51 and an outlet 21, a heat exchanger 41 to exchange heat with air introduced into the housing 10, and a fan 42 to circulate air into or out of the housing 10. The air conditioner 1 may include a frame 11 to support the heat exchanger 41, the fan 42, and the like inside the housing 10.

The housing 10 may form an overall appearance of the air conditioner 1. The housing 10 may include a front panel 20 having the outlet 21, a rear panel 60 disposed in the rear of the front panel 20, a pair of side panels 40 disposed between the front panel 20 and the rear panel 60, an upper panel 50 having the inlet 51 and disposed above the pair of side panels 40, and a lower panel 30 disposed below the pair of side panels 40. The disclosure exemplifies that the outlet 21 and the inlet 51 are provided in the front panel 20 and the upper panel 50, respectively, but are not limited thereto. The upper panel 50 may be provided with an inlet guide 52 to guide air to the inlet 51. A plurality of the inlet guides 52 may be formed side by side along a longitudinal direction of the housing 10.

The air conditioner 1 may include a discharge blade 22 to open and close the outlet 21. The discharge blade 22 is rotatably provided in the housing 10. The discharge blade 22 may be provided to be rotatable about a blade shaft 23 with respect to the front panel 20. The blade shaft 23 may be positioned on an inner surface of the front panel 20.

The air conditioner 1 may include an auxiliary blade 24 to control a direction of air blown from the fan 42 at an inner side of the discharge blade 22. The discharge blade 22 may control the blown air in the up-down direction, and the auxiliary blade 24 may control the blown air in the left-right direction. The one or more auxiliary blades 24 may be provided, and the plurality of auxiliary blades 24 may be arranged along a length direction of the outlet 21. The auxiliary blade 24 is positioned at the inner side of the discharge blade 22 so as not to be exposed to the outside when the discharge blade 22 closes the outlet 21.

The heat exchanger 41 is disposed inside the housing 10 and may be disposed on an air movement path from the inlet 51 to the outlet 21. The heat exchanger 41 is configured to absorb heat from air introduced into the inlet 21 or to transfer heat to the air. The heat exchanger 41 may be supplied with a refrigerant for heat exchange with air. The refrigerant may be supplied through a refrigerant pipe 43 connected to the heat exchanger 41 from the outside of the housing 10. A drain panel may be provided below the heat exchanger 41 such that dew condensed on the heat exchanger 41 may be collected. The drain panel may be connected to a drain pipe 44 connected to the outside of the housing 10 to discharge the condensed dew to the outside of the housing 10.

The fan 42 is disposed inside the housing 10. The fan 42 is configured to blow air from the inlet 51 to the outlet 21, The fan 42 may be a crossflow fan having the same length as the housing 10.

The discharge blade 22 may rotationally move a guide position and a close position. When in the close position, the discharge blade 22 may close the outlet 21. In the close position, the discharge blade 22 may prevent the components in the housing 10 from being exposed to the outside. The discharge blade 22 may be configured to correspond to the outlet 21. The discharge blade 22 may be formed to have a substantially plate shape. The discharge blade 22 may further include a plurality of holes to discharge air to the outside of the housing 10 even when the discharge blade 22 is in the close position.

The discharge blade 22 may be formed to be rotatable about the blade shaft 23. The discharge blade 22 is provided to control a direction of air blown from the fan 42 and discharged to the outlet 21 when in the guide position. The discharge blade 22 may change a direction of air discharged to the outside of the housing 10 according to a rotational angle about the blade shaft 23.

The lower panel 30 may form a lower surface together with a portion of side surfaces of the housing 10. A piping space 13 in which the refrigerant pipe 43 and the drain pipe 44 may be disposed may be formed at an inner side of the lower panel 30. The piping space 13 may be disposed at a lower portion of the housing 10. In addition to the refrigerant pipe 43 and the drain pipe 44, a power line 46, a communication line 47, and the like may be further disposed in the piping space 13. The refrigerant pipe 43 may be surrounded by an insulator 45 to insulate from the outside.

The lower panel 30 may include cutoff portions 33 and 34 by which a portion of the lower panel 30 may be cut. The cutoff portions 33 and 34 may be removed from the lower panel 30 such that the refrigerant pipe 43 disposed at the inner side of the lower panel 30 may be connected to the outside of the housing 10. The lower panel 30 may include the cutoff portion 33 formed on the lower surface of the housing 10 and the cutoff portion 34 formed on the side surface of the housing 10.

The air conditioner 1 may include a speech recognizer 100 configured to allow a user to manipulate the air conditioner 1 by speech. The speech recognizer 100 may be disposed in the piping space 13 formed at the inner side of the lower panel 30. The lower panel 30 may include a speaker opening 31 formed at a position corresponding to a speaker of the speech recognizer 100. The lower panel 30 may include a microphone opening 32 formed at a position corresponding to a microphone of the speech recognizer 100.

Although not shown in the drawings, the speech recognizer 100 may be disposed at an inner side of one of the upper panel 50, the front panel 20, and the side panels 40. Depending on the position of the speech recognizer 100, the speaker opening and the microphone opening may be provided on one of the upper panel 50, the front panel 20, and the side panels 40.

Figure 5:
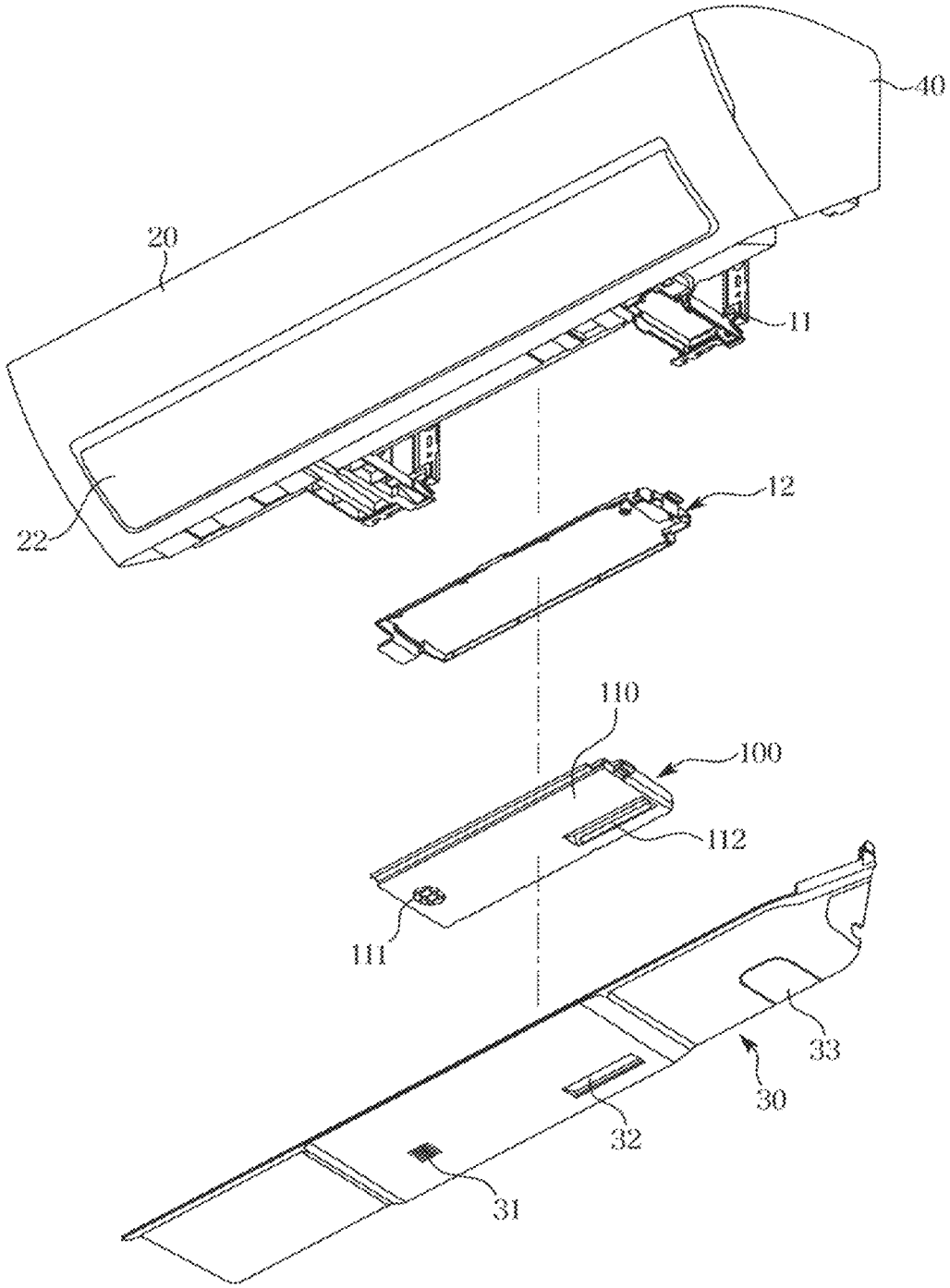
FIG. 5 is an exploded perspective view illustrating a state in which a lower panel, a speech recognizer, and a holder are disassembled in the air conditioner according to an embodiment of the disclosure.
Figure 6:
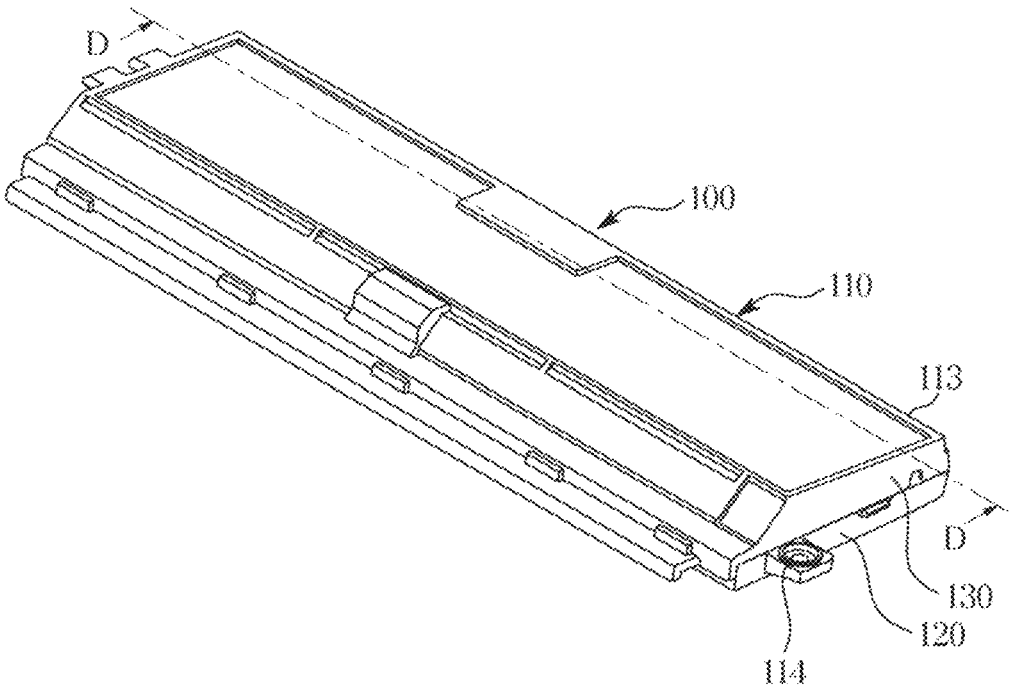
FIG. 6 is a perspective view of the speech recognizer of the air conditioner according to an embodiment of the disclosure.
Figure 7:
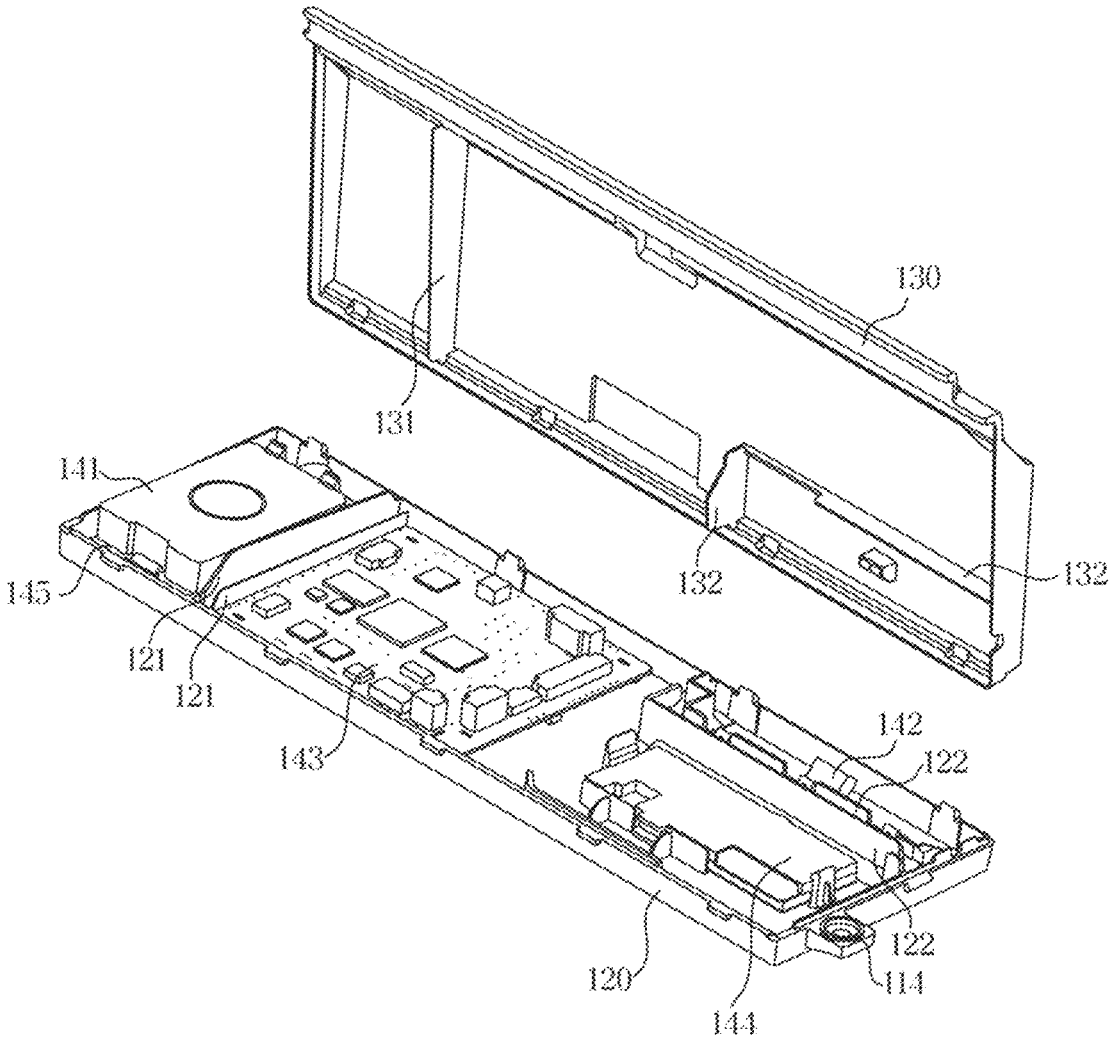
FIG. 7 is an exploded perspective view of a case of the speech recognizer of the air conditioner according to an embodiment of the disclosure.
Figure 8:
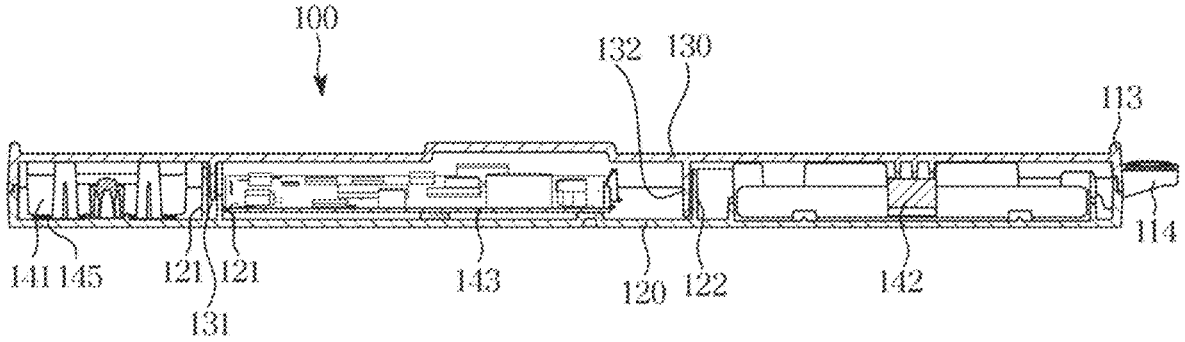
FIG. 8 is a cross-sectional view of the speech recognizer taken along line D-D in FIG. 6.
Figure 9:
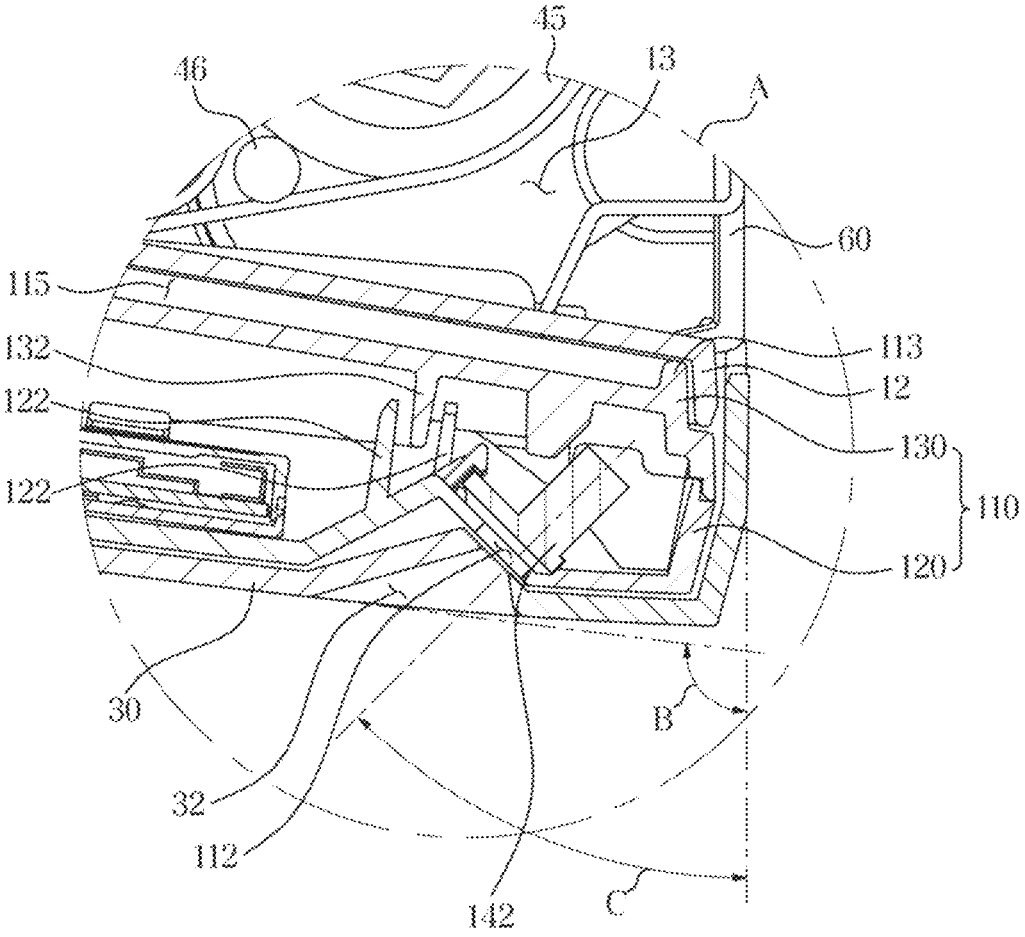
FIG. 9 is an enlarged view of a portion A in FIG. 4.

FIG. 5 is an exploded perspective view illustrating a state in which a lower panel, a speech recognizer, and a holder are disassembled in the air conditioner according to an embodiment of the disclosure. FIG. 6 is a perspective view of the speech recognizer of the air conditioner according to an embodiment of the disclosure, and FIG. 7 is an exploded perspective view of a case of the speech recognizer of the air conditioner according to an embodiment of the disclosure. FIG. 8 is a cross-sectional view of the speech recognizer taken along line D-D in FIG. 6, and FIG. 9 is an enlarged view of a portion A in FIG. 4.

The speech recognizer 100 may include a microphone 142 capable of receiving speech of the user. The speech recognizer 100 may include a speaker 141 capable of responding to manipulation by the speech of the user. The speech recognizer 100 may include a case 110 to accommodate the speaker 141 and the microphone 142. The case 110 may include a first member 120 and a second member 130 coupled to each other to form an inner space. For example, the first member 120 may be disposed at a lower side and the second member 130 may be disposed at an upper side.

The speech recognizer 100 may further include a controller 143 to control the speaker 141 and the microphone 142. The controller 143 may be configured of a circuit board and electronic components mounted on the circuit board. The speech recognizer 100 may include a wireless communication module (wireless communicator) for wireless communication such as WIFI, Bluetooth, and the like. The air conditioner 1 may be manipulated through wireless communication. The controller 143 may be configured to control the wireless communication module 144.

The speech recognizer 100 may be disposed at the lower portion of the housing 10. The piping space 13 may be disposed at the lower portion of the housing 10, and the speech recognizer 100 may be disposed in the piping space 13. When the air conditioner is installed, the lower panel 30 covering the piping space 13 is required to be separated from the air conditioner 1 for the piping of the refrigerant pipe 43 and the like. Because the speech recognizer 100 includes the case 110, even when the lower panel 30 is separated, components disposed inside the case 110 may not be exposed to the outside. In addition, when the speech recognizer 100 is out of order, only the speech recognizer 100 may be easily separated and repaired.

The air conditioner 1 may include a holder 12 on which the speech recognizer 100 may be mounted. The holder 13 may be coupled to the frame 11 of the air conditioner 1. The holder 13 may be disposed at a lower portion of the piping space 13. The speech recognizer 100 may include a coupling portion 114 that may be coupled to the holder 13 by screws or the like. The coupling portion 114 may be provided on the case 110. The coupling portion 114 may be provided on the first member 120 of the case 110.

When the speech recognizer 100 is disposed in the piping space 13, dew condensation may occur on an outer surface of the case 110 by the refrigerant pipe 43 installed in the piping space 13. The air conditioner 1 may include an air layer 115 provided on an outer side of the speech recognizer 100 to insulate the speech recognizer 100. The case 110 may include a protrusion portion 113 protruding outward to allow the air layer 115 to be formed. The air layer 115 may be formed between the case 110 of the speech recognizer 100 and the holder 12. The protrusion portion 113 may be formed to protrude toward the holder 12 on an outer surface of the second member 130 of the case 110.

Although not shown in the drawings, a protrusion portion for forming the air layer 115 may be provided on the holder 12. The holder 12 may include a protrusion portion protruding toward the speech recognizer 100 to allow the air layer 115 to be formed. At least one of the holder 12 and the case 110 of the speech recognizer 100 may include a protrusion portion to allow the air layer 115 to be formed.

The speech recognizer 100 may be arranged such that the speaker 141 and the microphone 142 directs to the lower portion of the housing 10. Components disposed inside the case 110 such as the speaker 141 and the microphone 142 may be mounted to the first member 120. The speech recognizer 100 may include a vibration reducing member 145 disposed between the speaker 141 and the case 110 such that vibration generated in the speaker 141 may not be transmitted to the microphone 142 through the case 110. When the speaker 141 is mounted on the first member 120, the vibration reducing member 145 may be disposed between the speaker 141 and the first member 120. The vibration reducing member 145 may be a vibration reducing pad formed of polyurethane.

The case 110 of the speech recognizer 100 may include a partition wall to prevent sound from the speaker 141 from entering the microphone 142 through the inside of the case 110. At least one of the first member 120 and the second member 130 of the case 110 may include a partition wall to isolate the speaker 141 and the microphone 142. The speaker 141 may be disposed in an isolation space formed by a partition wall 121 provided on the first member 120 and a partition wall 131 provided on the second member 130. The microphone 142 may be disposed in an isolation space formed by a partition wall 122 provided on the first member 120 and a partition wall 132 provided on the second member 130.

The partition walls 121 and 122 provided on the first member 120 may be formed as a double wall, and the partition walls 131 and 132 provided in the second member 130 may be formed as a single wall. When the first member 120 and the second member 130 are coupled, the partition walls 131 and 132 of the second member 130 may be inserted between the partition walls 121 and 122 of the first member 120. Through this, a speech transmission distance between the speaker 141 and the microphone 142 may increase.

A first opening 111 for the speaker 141 and a second opening 112 for the microphone 142 may be provided on the case 110 of the speech recognizer 100. The first opening 111 and the second opening 112 may be provided on a lower surface of the case 110. The first opening 111 and the second opening 112 may be provided on the first member 120. It is appropriate that the first opening 111 and the second opening 112 are disposed as far apart from each other as possible. The first opening 111 and the second opening 112 may be disposed at opposite end portions of the first member 120.

It is appropriate that the microphone 142 of the speech recognizer 100 is disposed as far away from the outlet 21 as possible such that a recognition rate of the user's speech is not lowered by noise of wind discharged from the outlet 21, The outlet 21 may be provided in the front of the housing 10, and the microphone 142 may be disposed in the rear of the lower portion of the housing 10. The outlet 21 may be provided on the front panel 20, and the microphone opening 32 may be disposed in the rear of the lower panel 30.

The microphone 142 may be disposed to be tilted toward the front to increase the recognition rate of the user's speech. The lower panel 30 of the housing 10 may be formed to be inclined upward in the front. An angle B between a wall on which the housing 10 is installed and the lower panel 30 may be 90 degrees or more. A range of speech reception of the microphone 142 is an angle B between the lower panel 30 and the wall. The air conditioner 1 mounted on the wall is mainly installed in a bedroom, and in this case, it is appropriate that the microphone 142 is installed such that an angle C between the microphone and the wall is 45 degrees. The microphone 142 may be installed at various angles according to the installation environment and the frequency of use of the air conditioner 1.

Although a few embodiments of the disclosure have been shown and described, it would be appreciated by those skilled in the art that changes may be made in these embodiments without departing from the principles and spirit of the disclosure in the scope of which is defined in the claims and their equivalents.

What is claimed is:

1. An air conditioner comprising:

a housing having an inlet and an outlet, the housing comprising:

a plurality of panels including an upper panel, a front panel, side panels, and a lower panel;

a piping space formed by the plurality of panels; and an opening formed at a lower part of the housing through which the piping space is accessible, the lower panel separable from the housing to cover or uncover the opening thereby covering or uncovering the piping space;

a heat exchanger accommodated in the piping space to exchange heat with air introduced into the inlet;

a fan configured to blow air heat-exchanged in the heat exchanger to the outlet;

a holder coupled to the housing and accommodated in the piping space; and a speech recognizer mountable to the holder in the piping space, the speech recognizer comprising:

a microphone;

a speaker; and a case accommodating the microphone and the speaker therein, the case configured to be coupled to the holder thereby accommodating the speech recognizer in the piping space;

wherein:

the speech recognizer is configured to operate the air conditioner using the microphone and the speaker;

based on the lower panel being separated from the housing, the speech recognizer is accessible through the opening and separable from the holder;

the case comprises a protrusion portion protruding from an outer surface of the case;

based on the coupling of the case and the holder, an air layer is formed between the holder and the outer surface of the case by the protrusion portion to insulate the speech recognizer;

based on the separating of the case from the holder, the air layer is not formed by the protrusion; and the air layer has a height corresponding to a height of the protrusion portion.

2. The air conditioner according to claim 1, further comprising a refrigerant pipe configured to supply a refrigerant to the heat exchanger therethrough and a drain pipe configured to discharge condensed water generated in the heat exchanger therethrough, wherein at least part of the refrigerant pipe and the drain pipe is in the piping space.

3. The air conditioner according to claim 2, wherein the microphone and the speaker are configured to direct to the lower part of the housing.

4. The air conditioner according to claim 1, wherein the speech recognizer further comprises a controller configured to control the microphone and the speaker.

5. The air conditioner according to claim 4, wherein the speech recognizer further comprises a wireless communicator, and the controller controls the wireless communicator to communicate with external wireless devices.

6. The air conditioner according to claim 1, wherein the case comprises a first member and a second member, and the first member comprises a first opening for the speaker and a second opening for the microphone.

7. The air conditioner according to claim 6, wherein at least one of the first member and the second member comprises a partition wall configured to isolate the speaker and the microphone.

8. The air conditioner according to claim 6, wherein the second member comprises the protrusion portion protruded from the outer surface of the second member.

9. The air conditioner according to claim 1, wherein the speech recognizer further comprises a vibration reducing pad formed of polyurethane and is between the case and the speaker to prevent vibration of the speaker from being transmitted to the microphone through the case.

10. The air conditioner according to claim 1, wherein the microphone is tilted toward a front of the housing.

11. The air conditioner according to claim 1, wherein the outlet is in a front of the housing, and the microphone is in a rear of the lower part of the housing.

12. The air conditioner according to claim 1, wherein the piping space is formed at an inner side of one of the upper panel, the front panel, the side panels, and the lower panel.

* * * * *